US005101803A

United States Patent [19]

Nakamura et al.

[11] Patent Number: 5,101,803

[45] Date of Patent: Apr. 7, 1992

[54] IGNITION COIL

[75] Inventors: Naotaka Nakamura, Nagoya; Shigemi Ito, Anjo, both of Japan

[73] Assignee: Nippondenso Co., Ltd., Kariya, Japan

[21] Appl. No.: 610,769

[22] Filed: Nov. 8, 1990

[30] Foreign Application Priority Data

Nov. 10, 1989 [JP] Japan ..... 1-293453

[51] Int. Cl.[5] ..... H01F 31/00; F02P 13/00

[52] U.S. Cl. ..... 123/634; 123/169 PA; 336/83; 336/107; 336/110

[58] Field of Search ..... 123/169 PA, 169 PH, 123/634, 635; 336/83, 107, 110

[56] References Cited

U.S. PATENT DOCUMENTS

| | | | |
|---|---|---|---|
| 3,195,020 | 7/1965 | Willutzki | 361/270 |
| 3,202,950 | 8/1965 | Penn | 336/192 |
| 3,209,295 | 9/1965 | Baermann | 123/634 X |
| 4,498,067 | 2/1985 | Kumokawa et al. | 336/83 X |
| 4,502,454 | 3/1985 | Hamai et al. | 123/597 |
| 4,617,907 | 10/1986 | Johansson et al. | 123/635 X |
| 4,627,407 | 12/1986 | Betz | 123/634 |
| 4,658,799 | 4/1987 | Kusaka et al. | 123/634 |
| 4,837,544 | 6/1989 | McDougal | 336/83 X |
| 4,893,105 | 1/1990 | Maeda et al. | 123/634 X |
| 4,990,881 | 2/1991 | Ooyabu | 123/634 X |

FOREIGN PATENT DOCUMENTS

| | | |
|---|---|---|
| 2464543 | 3/1981 | France . |
| 48-49425 | 10/1971 | Japan . |
| 59-195812 | 11/1984 | Japan . |
| 60-11624 | 4/1985 | Japan . |
| 63-70508 | 3/1988 | Japan . |
| 63-132411 | 6/1988 | Japan . |
| 64-8580 | 1/1989 | Japan . |
| 2199193 | 6/1988 | United Kingdom . |

*Primary Examiner*—Tony M. Argenbright
*Attorney, Agent, or Firm*—Cushman, Darby & Cushman

[57] ABSTRACT

An ignition coil disposed and used in the neighborhood of a part made of a conductive material is provided with a first core made of a magnetic material, around which a primary coil and a secondary coil are wound; and a second core made of a magnetic material and having a cylindrical portion, in which the primary coil and the secondary coil and the first core are contained, and forms a closed magnetic path in conjunction with the first core.

13 Claims, 9 Drawing Sheets

IGNITION COIL

BACKGROUND OF THE INVENTION

1. Field of the Invention

The present invention relates to an ignition coil used in an internal combustion engine.

2. Description of the Related Art

Heretofore, in a distributorless ignition (DLI) type internal combustion engine, for example, a circuit, in which a spark plug and an ignition coil are connected directly with each other, has been proposed (JP-A-63-132411, JP-A-64-8580, etc.).

An iron core for use in such an ignition coil is composed of an I-shaped first core 101, around which a primary coil (not shown in the figure) and a secondary coil (not shown in the figure) are wound, and a U-shaped second core 102 forming a closed magnetic path in conjunction with the first core 101, as shown in FIG. 19. Further, another ignition coil has been proposed in which a permanent magnet 103 is disposed for the purpose of increasing magnetic energy stored in the iron core so as to increase an induced electromotive force of the secondary coil by making (biasing) magnetic flux pass through the closed magnetic path.

Although such an ignition coil as described above is disposed between two banks of an internal combustion engine in order to connect it directly with a spark plug, it may be readily thought of to dispose the ignition coil within a plug tube 104 so as to be incorporated with the plug tube 104 which is made of iron to serve as a mounting hole for mounting a spark plug disposed between the two banks.

However, in the case of an ignition coil disposed in the plug tube 104, not only magnetic flux $\Phi_c$ passes through the closed magnetic path formed by the first core 101 and the second core 102, but also leakage flux $\Phi_L$ passes through the plug tube 104. Therefore, with the ignition coil described above, there is a possibility that an eddy current is produced in the plug tube 104, because the leakage magnetic flux $\Phi_c$ passes through the plug tube 104.

When such an eddy current is produced in the plug tube 104 in this way, the magnetic energy stored in the iron core decreases, resulting in electric power loss (eddy current loss).

For this reason, since an induced electromotive force generated in the secondary coil of the above-described ignition coil decreases significantly, such an ignition system has a drawback that a high voltage (a generated voltage) applied to the spark plug is significantly lowered (refer to the graph indicated in FIG. 20). In the graph indicated in FIG. 20, $I_1=6.5$ A represents the value of a current flowing through the primary coil. Furthermore, "a" indicates the case of an ignition coil disposed where there were no parts of an internal combustion engine made of a conductive material located in the neighborhood of the place. "b" indicates the case of an ignition coil disposed in the plug tube. In the experiments for making the comparison, an ignition coil was used in which a permanent magnet was disposed in the closed magnetic path of the ignition coil.

SUMMARY OF THE INVENTION

The object of the present invention is to provide an ignition coil capable of suppressing a reduction in the induced voltage generated by the secondary coil.

The ignition coil according to the present invention has a construction suitable for the arrangement thereof in the neighborhood of parts made of a conductive material, and it comprises a first core made of a magnetic material, around which a primary coil and a secondary coil are wound, and a second core made of a magnetic material having a cylindrical portion, in which the first core, the primary coil and the secondary coil described above are contained, and forming a closed magnetic path in conjunction with the first core. The abovementioned parts made of a conductive material are those made of a conductive material other than the first core and the parts include a plug tube, a cylinder cover, a cylinder head, a bracket for holding the ignition coil, etc. used in the internal combustion engine.

Even where there exist parts made of a conductive material in the neighborhood of the cylindrical portion of the second core, the magnetic flux passing through the first core is forced to pass through the cylindrical portion of the second core. As a result, the leakage of the magnetic flux from the closed magnetic path into the parts made of a conductive material is reduced, thereby making it difficult for an eddy current to be generated in the parts. Therefore, since a reduction in the magnetic energy stored in the core can be prevented, the eddy current loss is suppressed.

Since the eddy current loss can be suppressed, a decrease in the induced electromotive force generated in the secondary coil can be prevented. As a result, a decrease in the generated voltage of the secondary coil can be suppressed.

BRIEF DESCRIPTION OF THE DRAWINGS

FIGS. 1 to 5 show a first embodiment of the present invention, in which FIG. 1 is a partially sectional perspective view showing an ignition coil;

FIG. 2 is a plan view showing an iron core portion of the ignition coil;

FIG. 3 is a front sectional view showing the iron core portion of the ignition coil;

FIG. 4 is a partially sectional view showing the arrangement of the ignition apparatus used in a DLI type internal combustion engine; and FIG. 5 is a graph showing the generated voltage of the secondary coil in the present embodiment and in a first comparison example;

FIGS. 11 to 16 are explanatory drawings for explaining an advantage obtained when two permanent magnets are disposed in the closed magnetic path, in which FIG. 11 is a graph showing respectively the voltages generated in the secondary coils of ignition coils used in various examples for making a comparison;

FIG. 12 is a sectional view showing the iron core of an elongated ignition coil;

FIG. 13 is a graph showing bias magnetic flux densities at respective detecting positions on the iron core in a second comparison example;

FIG. 14 is a sectional view showing the iron core of the elongated ignition coil used in the second comparison example;

FIG. 15 is a graph showing bias magnetic flux densities at respective detecting positions on the iron core in a third comparison example; and FIG. 16 is a sectional view showing the iron core of the elongated ignition coil used in the third comparison example;

DESCRIPTION OF THE PREFERRED EMBODIMENTS

The ignition coil according to the present invention will be explained with reference to the embodiments of the present invention shown in FIGS. 1 to 10.

Figure 1:
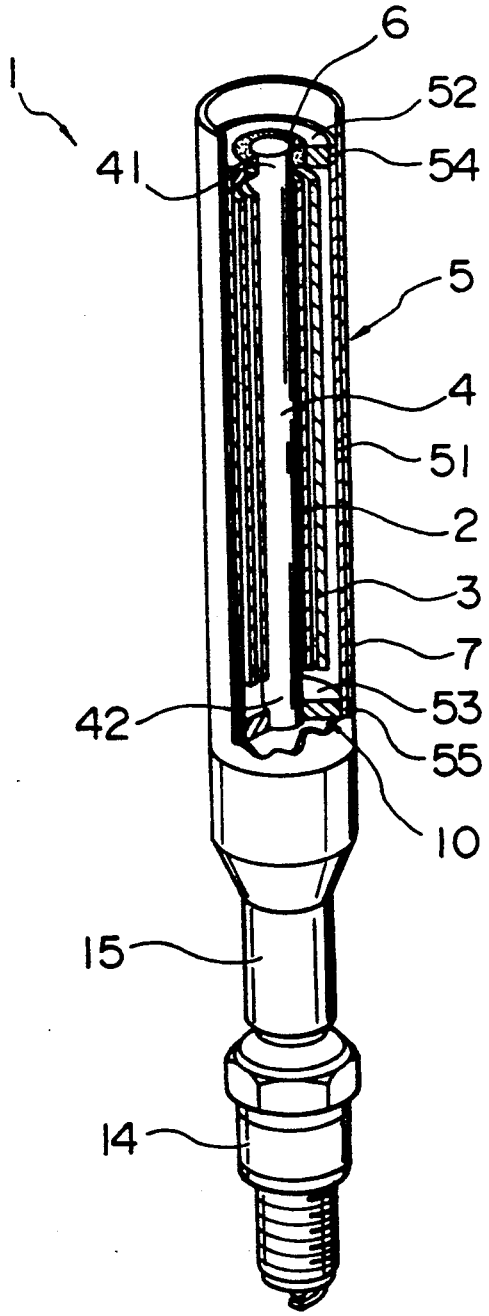
Figure 2:
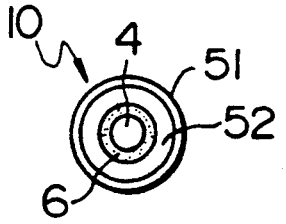
Figure 3:
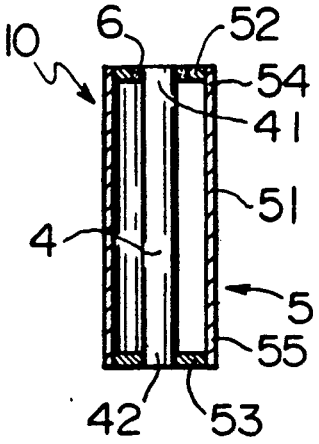
Figure 4:
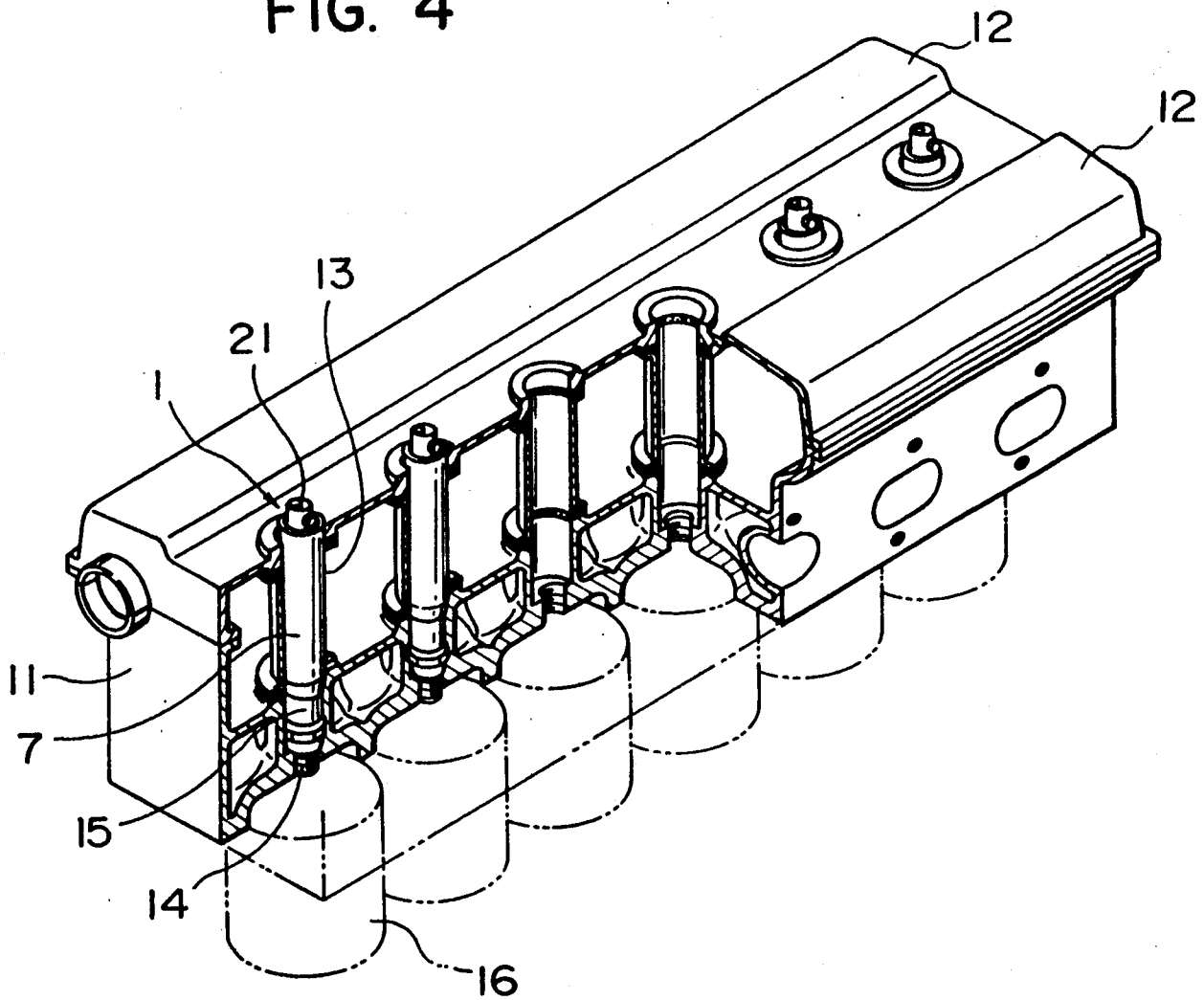

FIGS. 1 to 5 show a first embodiment of the present invention. FIGS. 1 to 3 show an ignition coil mounted on a DLI type internal combustion engine. FIG. 4 shows the DLI type internal combustion engine.

An ignition coil 1 is connected directly with a spark plug 14 disposed in a cylindrical plug tube 13 made of a conductive material such as iron, aluminium, etc. located between two banks 12 formed on a cylinder cover of a DLI type internal combustion engine 11. In the present embodiment, one ignition coil 1 feeds one spark plug 14 with a high voltage. The plug tube 13 is a part or component made of a conductive material included in the present invention.

The ignition coil 1 is composed of a primary coil 2, a secondary coil 3 and an iron core 10.

The primary coil 2 is wound on a bobbin (not shown in the figure) which is disposed around a first core 4 of the iron core 10 stated later. One end of this primary coil 2 is connected through a terminal 21 with a battery (not shown in the figure) mounted on a vehicle. Further, the other end of the primary coil 2 is connected also through the terminal 21 with an igniter (not shown in the figure). The igniter switches between a conductive state ($I_1=6.5$ A) and a non-conductive state of the primary coil 2.

The wire for use in the secondary coil 3 is finer and the number of turns thereof is greater than the primary coil 2, and it is wound on a bobbin (not shown in the figure) disposed around the first core 4. One end of the secondary coil 3 is connected with one end of the primary coil 2 and the other end of the secondary coil 3 is connected with the spark plug 14. The secondary coil 3 generates a high voltage when the primary coil 2 is switched over from its conductive state to its non-conductive state.

The iron core 10 is excited by making an electric current flow through the primary coil 2 to thereby store magnetic energy in the iron core 10 and releases the magnetic energy stored therein during the excitation by the stoppage of the conduction of the primary coil 2, thereby generating an induced electromotive force across the secondary coil 3.

This iron core 10 comprises the first core 4, a second core 5 forming a closed magnetic path in conjunction with the first core 4, and a permanent magnet 6 disposed in an air gap between the first core 4 and the second core 5.

The first core 4 is formed by punching a magnetic material (e.g. soft iron) to have a form of plates by using a press, etc., then laminating a plurality of the punched plates to have a form of a round bar, and then caulking the laminated plates having the form of a round bar with a press. The primary coil 2 and the secondary coil 3 are wound around the first core 4.

One end portion 41 of the first core 4 is located inside one end portion of the second core 5 to be opposite to the end portion of the second core 5 through an air gap. The other end portion of the first core 4 is located inside the other end portion of the second core 5 and is connected with the other end portion of the second core 5.

The second core 5 has an empty space on the inside thereof which can accommodates the primary coil 2, the secondary coil 3 and the first core 4 therein. The second core 5 is composed of a cylindrical core 51 and annular cores 52 and 53.

The cylindrical core 51 is the cylindrical portion provided according to the present invention. The cylindrical core 51 is formed by bending a flat plate made of a magnetic material (e.g. soft iron) substantially in a cylindrical form and locating it close to and in parallel with the inside surface of the plug tube. The inner surface of one end portion 54 of the cylindrical core 51 is directly engaged with the outer surface of the annular core 52. Furthermore, the inner surface of the other end portion 55 of the cylindrical core 51 is directly engaged with the outer surface of the annular core 53.

The annular core 52 is formed first by punching a flat plate made of a magnetic material (e.g. soft iron) to have an annular form by using a press, etc. Then, a plurality of the punched plate pieces are laminated, and then the laminated punched plate pieces are pressed and caulked to thereby obtain the annular core 52. The annular core 52 is positioned inside one end portion 41 of the first core 4. The inner surface of the annular core 52 is opposite to the one end 41 of the first core 4 through an air gap. Further, the outer surface of the annular core 52 is engaged with the one end portion 54 of the cylindrical core 51 to be linked directly therewith. Furthermore, a hole (not shown in the figure), through which lead wires connected to both ends of the primary coil 2 pass, is provided in the annular core 52.

The annular core 53 is formed first by punching a flat plate made of a magnetic material (e.g. soft iron) to have an annular form by using a press, etc. Then, a plurality of the punched plate pieces are laminated, and then the laminated punched plate pieces are pressed and caulked to thereby obtain the annular core 53. The inner surface of the annular core 53 is engaged with the other end portion 42 of the first core 4 so that the other end portion 42 of the first core 4 is fitted into the inside of the annular core 53. Furthermore, the outer surface of the annular core 53 is fitted inside of the other end portion 55 of the cylindrical core 51 so that the annular core 53 is directly linked with the latter. Furthermore, a hole (not shown in the figure), through which a lead wire connected with the other end of the secondary coil 3 passes, is formed in the annular core 53.

The permanent magnet 6 supplies bias magnetic flux to the closed magnetic path to thereby increase a voltage generated by the secondary coil 3. This permanent magnet 6 is formed to have an annular form. A neodymium magnet or a rare earth element magnet such as a rare earth element-cobalt magnet, etc. is used as the permanent magnet 6. This permanent magnet 6 is arranged to be fitted into an air gap between the one end portion 41 of the first core 4 and the inside surface of the annular core 52.

An assembly, including: the first core 4 on which the primary coil 2 and the secondary coil 3 are wound; the second core 5 comprising the cylindrical core 51 and the annular cores 52 and 53; and the permanent magnet 6, is put into an ignition coil case 7 made of a resin, and then injecting and hardening of a molding resin (not shown in the figure) is made therein to obtain the ignition coil 1. Further, a terminal 21 of the ignition coil 1 protrudes from one end portion of the ignition coil case 7 as shown in FIG. 4, and a plug cap 15 made of rubber for covering the terminal of the spark plug 14 is attached to the other end portion of the ignition coil case 7.

The operation of the ignition coil of this embodiment will be explained by making reference to FIGS. 1 to 5.

When a key switch (not shown in the figure) is switched on, the primary coil 2 and one end of the secondary coil 3 are connected with the battery mounted on the vehicle. Then, the igniter generates an ignition signal to make the primary coil 2 switch from the conductive state to the non-conductive state at time of ignition in response to the driving-mode conditions of the internal combustion engine, such as a crank angle, etc.

When an electric current flows through the primary coil 2, the second core 5 comprising the cylindrical core 51 and the annular cores 52 and 53 is magnetized, and magnetic flux passing through the first core 4 and the second core 5 is generated. The magnetic flux passing through the first core 4 and the second core 5 stores a great amount of magnetic energy in the iron core 10 in conjunction with the bias magnetic flux of the permanent magnet 6 arranged in the air gap between the one end portion 41 of the first core 4 and the inner surface of the annular core 52, even if an amount of intrinsic flux generation of the primary coil 2 per se is small.

Thus, when the primary coil 2 is switched over to the non-conductive state at the time of ignition by the operation of the igniter, the magnetic energy stored in the iron core 10 is released, and an induced electromotive force is generated in the secondary coil 3. The winding of the secondary coil 3 is fine and the number of turns thereof wound around the first core 4 is much greater than that of the primary coil 2. As a result, a high voltage is produced across the secondary coil 3 by the induced electromotive force. The high voltage generated across the secondary coil 3 is applied to the spark plug 14 and thus spark discharge is caused to occur in the combustion chambers 16 of the internal combustion engine. Thereafter, the conduction and non-conduction of the primary coil 2 are caused to occur repeatedly by the igniter, thereby causing the engine operation to be continued.

Here, when the primary coil 2 is made conductive thereby causing magnetic flux and be generated to pass through the iron core 10, there is a possibility that magnetic flux leaks in the plug tube 13 disposed on the outer surface of the cylindrical core 51 of the second core 5.

However, in the present embodiment, the cylindrical core 51 is disposed on the inner surface of the plug tube 13. Therefore, the magnetic flux, which is caused to pass from the first core 4 through the annular cores 52 and 53, passes through the cylindrical core 51 of the second core 5 without leaking so much in the plug tube 13. For this reason, the leakage magnetic flux in the plug tube 13 is reduced significantly as compared with a conventional ignition coil having no cylindrical core 51. In this way, an eddy current is prevented from flowing through the plug tube 13 due to the fact that the leakage magnetic flux in the plug tube 13 is reduced significantly.

Thus, since a reduction in an amount of magnetic energy stored in the iron core 10 can be prevented, it is possible to suppress generation of eddy current loss. Therefore, since a decrease in an induced electromotive force generated across the secondary coil 3 of the ignition coil 1 can be suppressed, it is possible to apply a desired high generated voltage from the secondary coil 3 to the spark plug 14.

Figure 20:
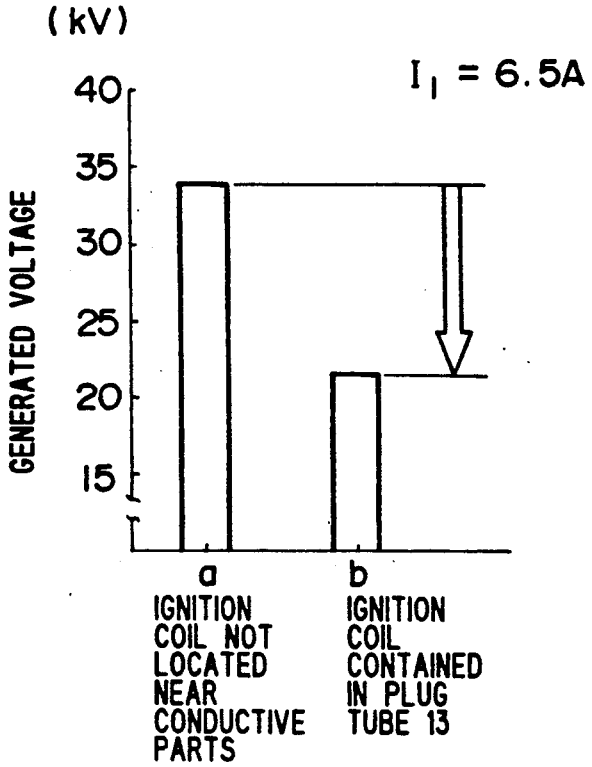
FIG. 20 PRIOR ART
FIG. 20 is a graph showing a comparison in the magnitude of the generated voltage in the secondary coil between two prior art ignition coils.

Thus, the voltage generated across the secondary coil 3 of the ignition coil of the present embodiment is only slightly less as compared with that of an exemplified ignition coil shown for the purpose of comparison in which the ignition coil is used at a place in a region in which no conductive parts are located. (Refer to the graph shown in FIG. 5.) That is, it is possible to increase remarkably a voltage generated across the secondary coil 3 as compared with a voltage generated by an ignition coil provided with no cylindrical core 51 (refer to the graph shown in FIG. 20).

Figure 5:
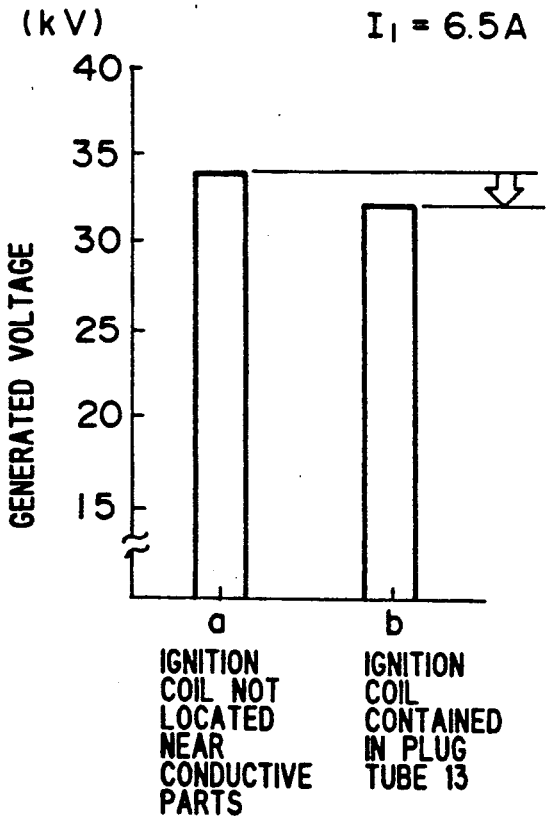

FIG. 5 is a graph showing respectively the voltages generated across the secondary coils of the ignition coil of the present embodiment and the ignition coil of an example used for comparison, in which "a" indicates the ignition coil 1 having the structure shown in the present embodiment and positioned at a place where there are no parts made of a conductive material in the neighborhood thereof, and "b" indicates the ignition coil 1 contained in the plug tube 13 of the present embodiment.

Figure 6:
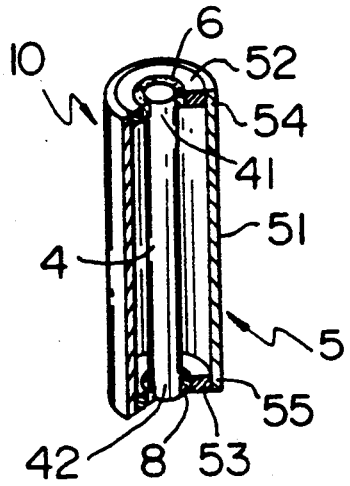
FIG. 6 is a partially sectional perspective view showing the iron core portion of an ignition coil in accordance with a second embodiment of the present invention.

FIG. 6 shows an ignition coil for an internal combustion engine used in a second embodiment of the present invention.

In this embodiment, along with the permanent magnet 6, another permanent magnet 8 is disposed between the other end portion 42 of the first core 4 and the inner surface of the annular core 53 of the second core 5.

The reason why the two permanent magnets 6 and 8 are disposed in the closed magnetic path will be explained, referring to FIGS. 11 to 16.

Figure 11:
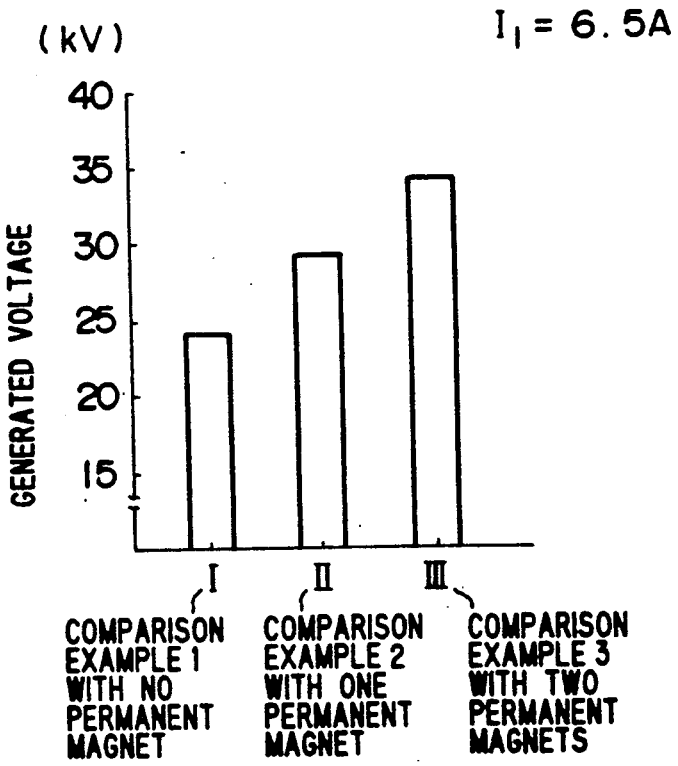

FIG. 11 is a graph showing voltages generated across the secondary coils of the ignition coils using the iron core I of the comparison example 1, the iron core II of the comparison example 2, and the iron core III of the comparison example 3, respectively. The iron core I of the comparison example 1 has no permanent magnet; the iron core II of the comparison example 2 has one permanent magnet; and the iron core III of the comparison example 3 has two permanent magnets.

Figure 12:
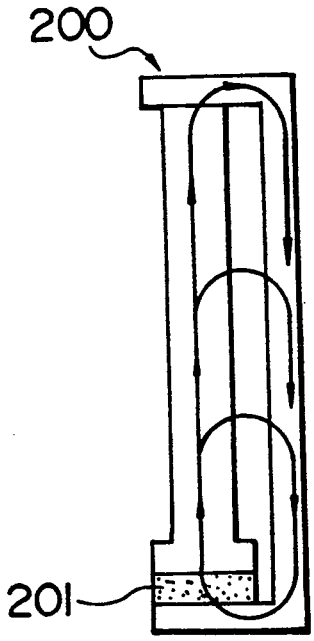

Heretofore, it has been known to dispose a permanent magnet 201 in the closed magnetic circuit of the iron core of an ignition coil, as shown in FIG. 12, so that magnetic flux generated by the permanent magnet 201 passes through the whole closed magnetic path to thereby increase magnetic energy stored in the iron core. In this way, by increasing the magnetic energy stored in the iron core of an ignition coil, it becomes possible to increase an induced electromotive force in the secondary coil of the ignition coil and thereby to increase the magnitude of a high generated voltage to be applied to a spark plug (refer to FIG. 11).

However, in the case where an elongated iron core 200 (iron core II of the comparison example 2 shown in FIG. 11) was used in an ignition coil as shown in FIG. 12 in order to install the ignition coil in the plug tube 13 of the internal combustion engine 11, it was not possible to increase satisfactorily a voltage generated across the secondary coil, even if a permanent magnet 201 was disposed in the closed magnetic path.

Figure 13:
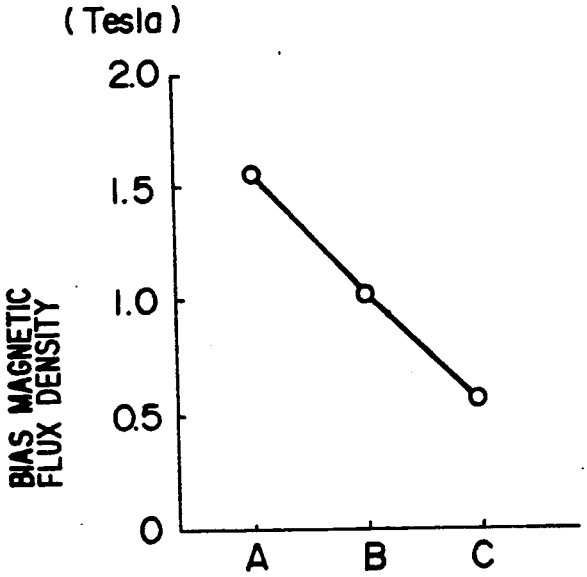
Figure 14:
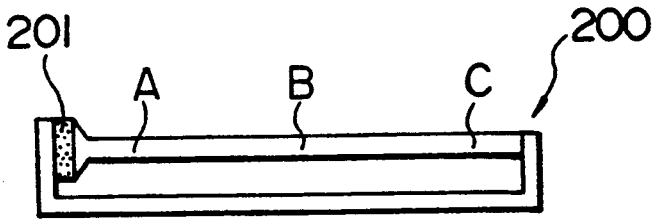

The reason for the disadvantage that it was not possible to increase satisfactorily an electromotive force induced in the secondary coil even by disposing the permanent magnet 201 resided in the fact that, since the closed magnetic path is elongated, the bias magnetic flux generated by the permanent magnet 201 was unable to reach so far, so that the bias magnetic flux did not extend uniformly over the whole closed magnetic path (refer to the graph shown in FIG. 13).

FIG. 13 is a graph showing the relationship between the detecting positions on the iron core II of the comparison example 2 (shown in FIG. 11) and the bias magnetic flux densities (in Tesla) corresponding to the detecting positions. The bias magnetic flux densities in the iron core II of the comparison example 2 were detected at the points A, B and C shown in FIG. 14, respectively.

Figure 15:
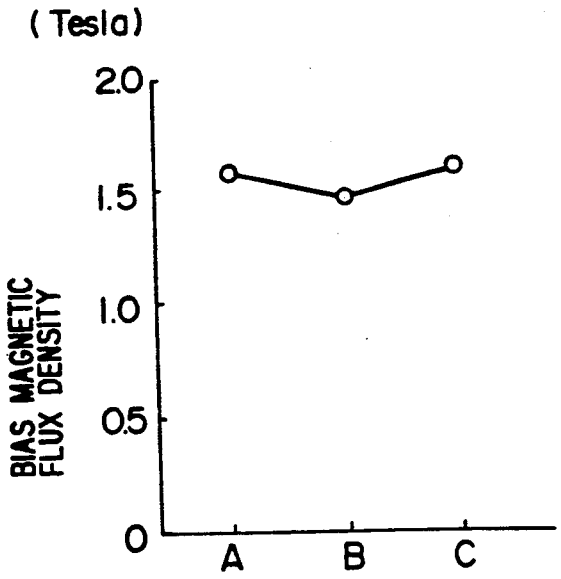
Figure 16:
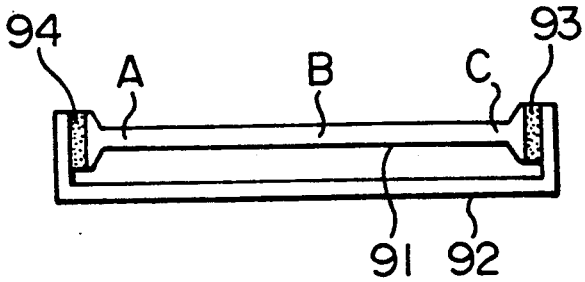

In order to solve the problem that the bias magnetic flux does not extend over the entire closed magnetic path, the iron core III of the comparison example 3 is used in which two permanent magnets 93 and 94 are disposed in both air gaps between the first core 91 and the second core 92, respectively, as shown in FIG. 16. By virtue of this structure, the bias magnetic flux is able to extend uniformly over the entire elongated closed magnetic path (refer to the graph shown in FIG. 15) and thereby to increase the magnetic energy stored in the iron core. In accordance with the graph in FIG. 11, it is clearly seen that the ignition coil using the iron core III of the comparison example 3 can increase remarkably the voltage generated across the secondary coil as compared with the ignition coil using the iron core II of the comparison example 2.

FIG. 15 is a graph showing the relationship between the detecting positions on the iron core (iron core III of the comparison example 3) of an elongated ignition coil and the bias magnetic flux densities (in Tesla) corresponding to the detecting positions. The bias magnetic flux density of the iron core III of the comparison example 3 was detected at the detecting points A, B and C shown in FIG. 16.

Figure 17:
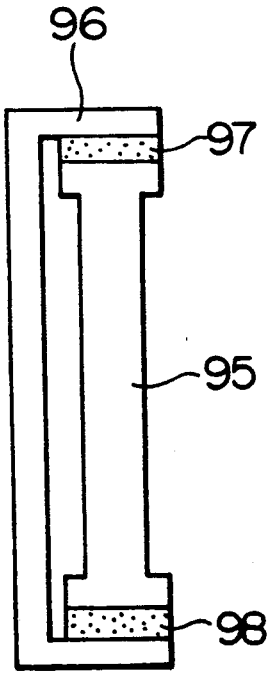
FIGS. 17 and 18 show modified embodiments for the iron core of an ignition coil in an internal combustion engine in which two permanent magnets are disposed in the closed magnetic paths, respectively.
Figure 18:
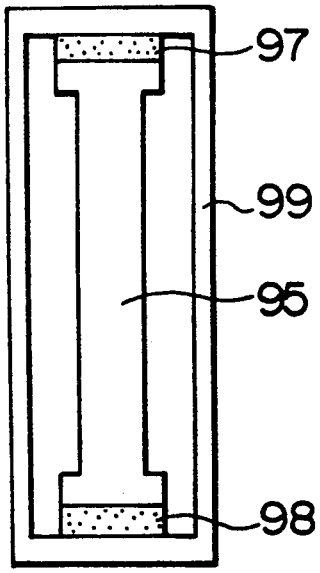
Figure 19:
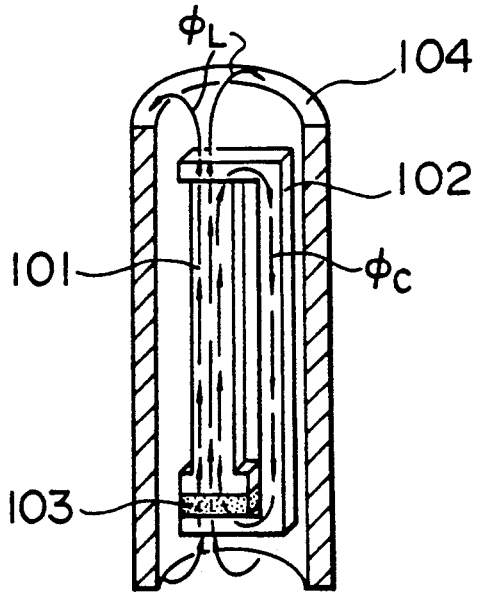
FIG. 19 PRIOR ART
FIG. 19 is a sectional view showing the iron core of a prior art ignition coil disposed in a plug tube.

FIGS. 17 and 18 show variations of the iron core of the ignition coil for an internal combustion engine wherein two permanent magnets are disposed in the closed magnetic path, respectively.

In the iron core of the ignition coil for an internal combustion engine shown in FIG. 17, permanent magnets 97 and 98 are disposed between an I-shaped core 95 and a U-shaped core 96, respectively. In the iron core of the ignition coil for an internal combustion engine shown in FIG. 18, permanent magnets 97 and 98 are disposed between an I-shaped core 95 and a rectangular-frame-shaped core 99.

Figure 7:
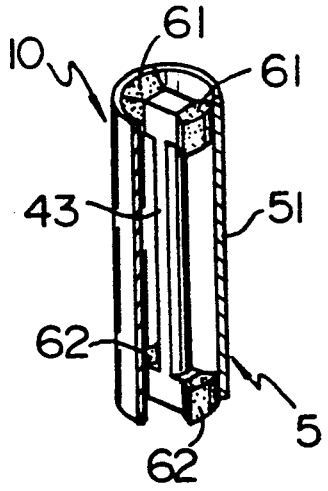
FIG. 7 is a partially sectional perspective view showing the iron core portion of an ignition coil in accordance with a third embodiment of the present invention.

FIG. 7 shows an ignition coil for an internal combustion engine of a third embodiment of the present invention.

In this embodiment, the annular cores 52 and 53 are removed, and, in place thereof, permanent magnets 61 and 62 are disposed between the outer surface of both end portions of a first core 43, which has an I-shaped external form and a rectangular cross-section, and the inner surface of both end portions of the cylindrical core 51, respectively. Each of the permanent magnets 61 and 62 is divided into two sector-shaped portions so that two ends of the wiring of the primary coil 2 and the other end of the wiring of the secondary coil 3 can easily pass through.

Figure 8:
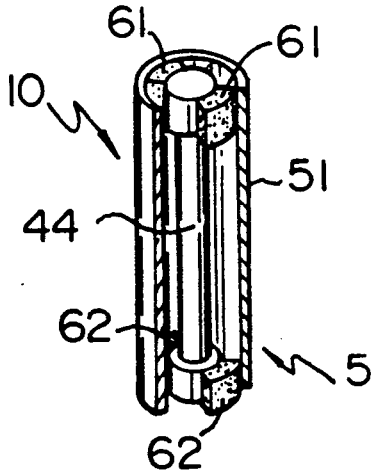
FIG. 8 is a partially sectional perspective view showing the iron core portion of an ignition coil in accordance with a fourth embodiment of the present invention.

FIG. 8 shows an ignition coil for an internal combustion engine of a fourth embodiment of the present invention. In this embodiment, the first core 43 of the third embodiment is changed to a first core 44 having an external form of a round bar.

Figure 9:
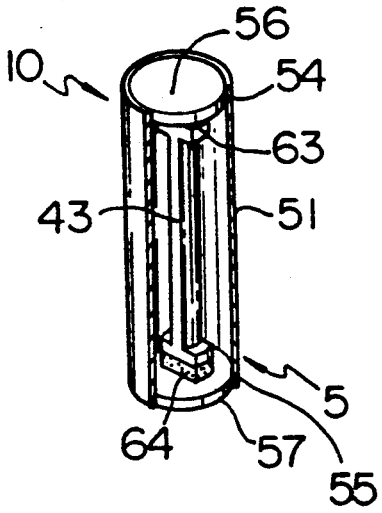
FIG. 9 is a partially sectional perspective view showing the iron core portion of an ignition coil in accordance with a fifth embodiment of the present invention.

FIG. 9 shows an ignition coil for an internal combustion engine of a fifth embodiment of the present invention.

In this embodiment, the second core 5 is composed of a cylindrical core 51 and disk-shaped cores 56 and 57 which are disposed inside the respective end portions of the cylindrical core 51. Furthermore, in this embodiment, permanent magnets 63 and 64 each having a parallelepiped-shaped external form are disposed between both longitudinal end surfaces of the first core 43, which has an I-shaped external form and a rectangular cross-section, and the inner surfaces of the disk-shaped cores 56 and 57, respectively.

Figure 10:
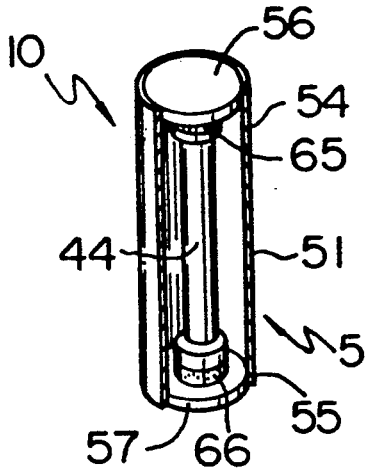
FIG. 10 is a partially sectional perspective view showing the iron core portion of an ignition coil in accordance with a sixth embodiment of the present invention.

FIG. 10 shows an ignition coil for an internal combustion engine of a sixth embodiment of the present invention. In this embodiment, the first core 43 of the fifth embodiment is changed to a first core 44 having an external form of a round bar. Further, disk-shaped permanent magnets 65 and 66 are disposed between both longitudinal end surfaces of the first core 44 and the inner surfaces of the disk-shaped cores 56 and 57, respectively.

Additional variations of the embodiment of this invention will be explained hereunder.

In the foregoing embodiments, permanent magnets are disposed in the closed magnetic path. However no permanent magnets may be disposed therein.

In the third to sixth embodiments, permanent magnets are disposed between both end portions of the first and second cores, respectively, permanent magnet(s) may be disposed between only one side end portions of the first and second cores, respectively.

In the foregoing embodiments, a cylindrical core is used as a cylindrical constituent member of the second core. However, the cylindrical constituent member of the second core may not be completely cylindrical. For example, it may have a shape of a right polygonal cylinder or a shape of a cylinder which has gap(s) formed partially in the longitudinal direction.

Furthermore, in the case where the second core comprises a cylindrical constituent member which has gap(s) formed therein, it is possible to prevent an eddy current from flowing in the peripheral direction of the cylindrical constituent member itself by positively making use of the joint gap(s) as slit(s).

Also, in the foregoing embodiments, the ignition coil is disposed in the cylindrical plug tube 13 made of iron located between the banks of a DLI type internal combustion engine. However, the ignition coil may be disposed directly between the banks of the internal combustion engine.

In addition, in the foregoing embodiments, the arrangement has been made so that one ignition coil feeds a single spark plug. However, one ignition coil may be arranged to feed two or more spark plugs.

We claim:

1. An ignition coil adapted to be disposed in the neighborhood of a part made of a conductive material, comprising:

a bar-shaped first core made of a magnetic material;

a primary coil and a secondary coil wound around said first core;

a second core made of a magnetic material and having a cylindrical portion, in which said primary coil, said secondary coil and said first core are contained, and forming a closed magnetic path in conjunction with said first core; and at least one biasing permanent magnet disposed around at least one end portion of said first core in the form of a ring, between said first core and said second core.

2. An ignition coil adapted to be disposed in the neighborhood of a part made of a conductive material, comprising:

a bar-shaped first core made of a magnetic material;

a primary coil and a secondary coil wound around said first core;

a second core made of a magnetic material and having a cylindrical portion, in which said primary coil, said secondary coil and said first core are contained, and forming a closed magnetic path in conjunction with said first core; and at least one biasing permanent magnet divided into a plurality of segments which are disposed around at least one end portion of said first core, between said first core and said second core.

3. An ignition coil according to claim 2, further comprising annular cores made of a magnetic material disposed between said first core and said second core.

4. An ignition coil according to claim 2, wherein said first core is formed to have a round bar shape.

5. An ignition coil according to claim 2, further comprising biasing permanent magnets disposed between both end portions of said first core and said second core, respectively.

6. An ignition coil according to claim 2, wherein said first core is formed to have a round bar shape by caulking an assembly of magnetic material members by using a press to thereby increase its space factor.

7. An ignition coil according to claim 2 wherein said first core is formed by laminating a plurality of flat-plate-shaped magnetic material members to have a round bar shape and then by caulking a resultant laminated body having the round bar shape by using a press to thereby increase its space factor.

8. An ignition coil having an elongated external shape which is inserted in a plug hole of an internal combustion engine and connected directly with a spark plug, comprising:

a bar-shaped first core made of a magnetic material;

a primary coil and a secondary coil wound around said first core;

a second core made of a magnetic material and having a cylindrical portion, in which said primary coil, said secondary coil and said first core a contained, and forming a closed magnetic path in conjunction with said first core; and at least one biasing permanent magnet disposed around at least one end portion of said first core in the form of a ring, between said first core and said second core.

9. An ignition coil having an elongated external shape which is inserted in a plug hole of an internal combustion engine and connected directly with a spark plug, comprising:

a bar-shaped first core made of a magnetic material;

a primary coil and a secondary coil wound around said first core;

a second core made of a magnetic material and having a cylindrical portion, in which said primary coil, said secondary coil and said first core are contained, and forming a closed magnetic path in conjunction with said first core; and at least one permanent magnet divided into a plurality of segments which are disposed around at least one end portion of said first core, between said first core and said second core.

10. An ignition coil according to claim 9 further comprising annular cores made of a magnetic material disposed between said first core and said second core.

11. An ignition coil according to claim 9, wherein said first core is formed to have a round bar shape.

12. An ignition coil according to claim 9, further comprising biasing permanent magnets disposed between both end portions of said first core and said second core, respectively.

13. An ignition coil having an elongated external shape which is inserted in a plug hole of an internal combustion engine and connected directly with a spark plug, comprising:

a bar-shaped first core made of a magnetic material;

a primary coil and a secondary coil wound around said first core;

a second core made of a magnetic material and having a cylindrical portion, in which said primary coil, said secondary coil and said first core are contained, and forming a closed magnetic path in conjunction with said first core; and biasing permanent magnets divided into a plurality of segments which are disposed between both end portions of said first core and said second core.

* * * * *